US008789395B2

(12) United States Patent
Hong et al.

(10) Patent No.: US 8,789,395 B2
(45) Date of Patent: Jul. 29, 2014

(54) WASHING MACHINE AND BALANCER THEREOF

(75) Inventors: Dae Young Hong, Suwon-si (KR); Sung Jin Kim, Seongnam-si (KR); Hong Seok Ko, Yongin-si (KR); Hyun Bae Kim, Yongin-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 798 days.

(21) Appl. No.: 12/805,242

(22) Filed: Jul. 20, 2010

(65) Prior Publication Data

US 2011/0094270 A1 Apr. 28, 2011

(30) Foreign Application Priority Data

Oct. 23, 2009 (KR) ..... 10-2009-0101265

(51) Int. Cl.
*B08B 3/00* (2006.01)

(52) U.S. Cl.
USPC ..... 68/3 R

(58) Field of Classification Search
None
See application file for complete search history.

(56) References Cited

U.S. PATENT DOCUMENTS

| | | | | |
|---|---|---|---|---|
| 5,561,993 | A | 10/1996 | Elgersma et al. | |
| 2005/0144736 | A1 * | 7/2005 | Jones | 8/158 |
| 2008/0110212 | A1 * | 5/2008 | Kim et al. | 68/23.2 |
| 2009/0151398 | A1 * | 6/2009 | Fang et al. | 68/12.02 |

FOREIGN PATENT DOCUMENTS

| | | |
|---|---|---|
| CN | 1095896 | 12/2002 |
| EP | 1 167 612 A2 | 1/2002 |
| JP | 6-134205 | 5/1994 |
| WO | 95/20702 | 8/1995 |

OTHER PUBLICATIONS

European Search Report dated Feb. 1, 2011 in corresponding European Patent Application 10170990.5.
Chinese Office Action issued Jan. 23, 2014 in corresponding Chinese Application No. 201010255719.1.

* cited by examiner

*Primary Examiner* — Jason Ko
(74) *Attorney, Agent, or Firm* — Staas & Halsey LLP

(57) ABSTRACT

The washing machine includes a rotating tub arranged to be rotatable about a shaft. A first mass member is mounted to the rotating tub so as not to be moved relative to the rotating tub in a circumferential direction of the rotating tub. The first mass member serves to apply load imbalance to the rotating tub upon rotation of the rotating tub. Also, a second mass member is arranged to be movable in the circumferential direction of the rotating tub. The second mass member serves to compensate for load imbalance of the rotating tub upon rotation of the rotating tub.

12 Claims, 9 Drawing Sheets

WASHING MACHINE AND BALANCER THEREOF

CROSS-REFERENCE TO RELATED APPLICATIONS

This application claims the benefit of Korean Patent Application No. 2009-0101265, filed on Oct. 23, 2009 in the Korean Intellectual Property Office, the disclosure of which is incorporated herein by reference.

BACKGROUND

1. Field

Embodiments relate to a washing machine having a balancer to compensate for load imbalance.

2. Description of the Related Art

In general, a washing machine includes a rotating tub in which laundry, such as clothes, etc. is received, and a motor to drive the rotating tub. The washing machine performs a series of operations, including washing, rinsing, and dehydrating (drying) operations, by use of rotational motion of the rotating tub.

If laundry is gathered in a specific partial region of the rotating tub, rather than being evenly distributed in the rotating tub, during rotation of the rotating tub, this may cause generation of vibration and noise due to eccentric rotation of the rotating tub. In the worst case, this may cause damage to the rotating tub or the motor.

For this reason, the washing machine includes a balancer to compensate for load imbalance caused in the rotating tub, so as to stabilize rotation of the rotating tub.

SUMMARY

Therefore, it is an aspect to provide a balancer having improved performance and a washing machine having the same.

Additional aspects will be set forth in part in the description which follows and, in part, will be apparent from the description, or may be learned by practice of embodiments of the invention.

In accordance with one aspect, a washing machine includes a rotating tub arranged to be rotatable about a shaft, a first mass member mounted to the rotating tub so as not to be moved relative to the rotating tub in a circumferential direction of the rotating tub, the first mass member serving to apply load imbalance to the rotating tub upon rotation of the rotating tub, and a second mass member arranged to be movable in the circumferential direction of the rotating tub, the second mass member serving to compensate for load imbalance of the rotating tub upon rotation of the rotating tub.

The first mass member may be fixed to the rotating tub.

The washing machine may further include a balancer housing having an annular channel to receive the second mass member.

A cross section of at least a part of the second mass member may have a shape corresponding to the cross section of the channel.

A fluid may be received in the channel to prevent sudden movement of the second mass member.

Only a single mass member may be received in the balancer housing.

The first mass member may be arranged inside the balancer housing in a radial direction of the rotating tub.

The rotating tub may include a cylindrical portion, and a front plate and a rear plate arranged respectively at front and rear ends of the cylindrical portion, and the first mass member and the balancer housing may be installed to at least one of the front plate and the rear plate.

A mass of the second mass member may be greater than a mass of the first mass member.

A distance between the shaft and the second mass member may be greater than a distance between the shaft and the first mass member.

The circumferential movement of the second mass member may be performed only by sliding movement.

The cross section of the second mass member may have a constant size in the circumferential direction of the rotating tub.

The second mass member may have a tapered surface portion formed at an end thereof.

In accordance with another aspect, a washing machine includes a rotating tub, a first mass member fixed to the rotating tub and serving to apply load imbalance to the rotating tub upon rotation of the rotating tub, a balancer housing mounted to the rotating tub and having an annular channel therein, a second mass member arranged to slide in the channel, and a damping fluid received in the channel and serving to apply resistance to the second mass member so as to prevent sudden movement of the second mass member.

A mass of the second mass member may be greater than a mass of the first mass member.

The cross section of the second mass member may have a shape corresponding to the cross section of the channel, and at least a part of the cross section of the second mass member may have a constant size in a circumferential direction of the rotating tub.

In accordance with a further aspect, in a balancer usable with a washing machine to compensate for load imbalance applied to a rotating tub of the washing machine, the balancer includes a first mass member provided at the rotating tub to cause load imbalance upon rotation of the rotating tub, a balancer housing provided at the rotating tub and having a channel extending in a circumferential direction of the rotating tub, a second mass member arranged to be movable in the channel and having a cross sectional shape corresponding to a cross sectional shape of the channel, and a damping fluid received in the channel to apply resistance to the second mass member when force acts on the second mass member.

BRIEF DESCRIPTION OF THE DRAWINGS

These and/or other aspects will become apparent and more readily appreciated from the following description of the embodiments, taken in conjunction with the accompanying drawings of which.

DETAILED DESCRIPTION

Figure 1:
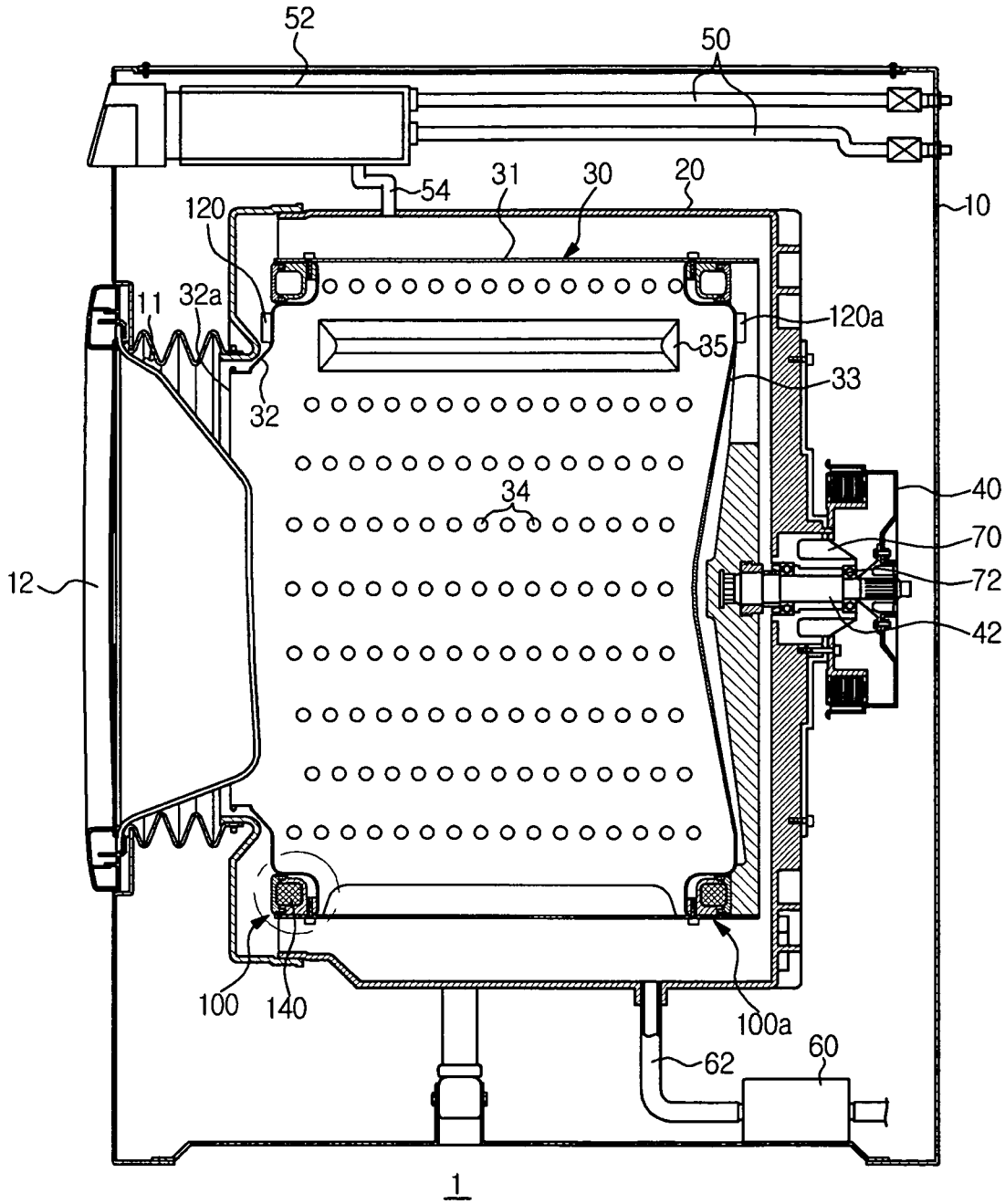
FIG. 1 is a view illustrating a configuration of a washing machine according to an exemplary embodiment.

Reference will now be made in detail to the embodiments, examples of which are illustrated in the accompanying drawings, wherein like reference numerals refer to like elements throughout. FIG. 1 is a view illustrating a configuration of a washing machine according to an exemplary embodiment.

As shown in FIG. 1, a washing machine 1 includes a cabinet 10 defining an external appearance of the washing machine 1, a tub 20 arranged in the cabinet 10, a rotating tub 30 rotatably arranged in the tub 20, and a motor 40 to drive the rotating tub 30.

The cabinet 10 has an opening 11 formed in a front surface thereof to put laundry into the rotating tub 30. A door 12 is installed to the front surface of the cabinet 10 to open or close the opening 11.

A water supply pipe 50 is installed above the tub 20 to supply wash water into the tub 20. One end of the water supply pipe 50 is connected to an external water supply source (not shown) and the other end of the water supply pipe 50 is connected to a detergent supply device 52.

The detergent supply device 52 is connected to the tub 20 via a connection pipe 54. When water is supplied into the tub 20 via the water supply pipe 50, the water passes through the detergent supply device 52 prior to being supplied into the tub 20, allowing detergent dissolved water to be supplied into the tub 20.

A drain pump 60 and a drain pipe 62 are mounted below the tub 20 to discharge the water from the tub 20 to the outside of the cabinet 10.

The rotating tub 30 includes a cylindrical portion 31, a front plate 32 arranged at a front end of the cylindrical portion 31, and a rear plate 33 arranged at a rear end of the cylindrical portion 31. The front plate 32 has an opening 32*a* for the entrance/exit of laundry. A drive shaft 42 of the motor 40 is connected to the rear plate 33 for power transmission from the motor 40 to the rotating tub 30.

The rotating tub 30 has a plurality of holes 34 perforated in the cylindrical portion 31 for passage of wash water. A plurality of lifters 35 is installed to an inner peripheral surface of the rotating tub 30 to raise and drop laundry during rotation of the rotating tub 30.

The drive shaft 42 is arranged between the rotating tub 30 and the motor 40. One end of the drive shaft 42 is connected to the rear plate 33 of the rotating tub 30 and the other end of the drive shaft 42 extends outward from a rear wall of the tub 20. When the motor 40 drives the drive shaft 42, the rotating tub 30 connected to the drive shaft 42 is rotated about the drive shaft 42.

A bearing housing 70 is installed to the rear wall of the tub 20, to rotatably support the drive shaft 42. The bearing housing 70 may be made of an aluminum alloy, and may be insert-molded to the rear wall of the tub 20 upon injection molding of the tub 20. Bearings 72 may be provided between the bearing housing 70 and the drive shaft 42 to assure smooth rotation of the drive shaft 42.

During a washing operation, the motor 40 rotates the rotating tub 30 in a forward direction or in a reverse direction at a low speed, such that laundry received in the rotating tub 30 is repeatedly raised and dropped to enable removal of dirt, etc. from the laundry.

During a dehydrating (drying) operation, the motor 40 rotates the rotating tub 30 at a high speed in a given direction, such that water is separated from laundry under the influence of centrifugal force acting on the laundry.

If laundry is gathered in a specific partial region, rather than being evenly distributed in the rotating tub 30, while the rotating tub 30 is rotated during the dehydrating (drying) operation, the rotating tub 30 exhibits unstable rotational motion, causing generation of vibration and noise.

Accordingly, the washing machine 1 includes a balancer 100 to stabilize rotational motion of the rotating tub 30.

Figure 2:
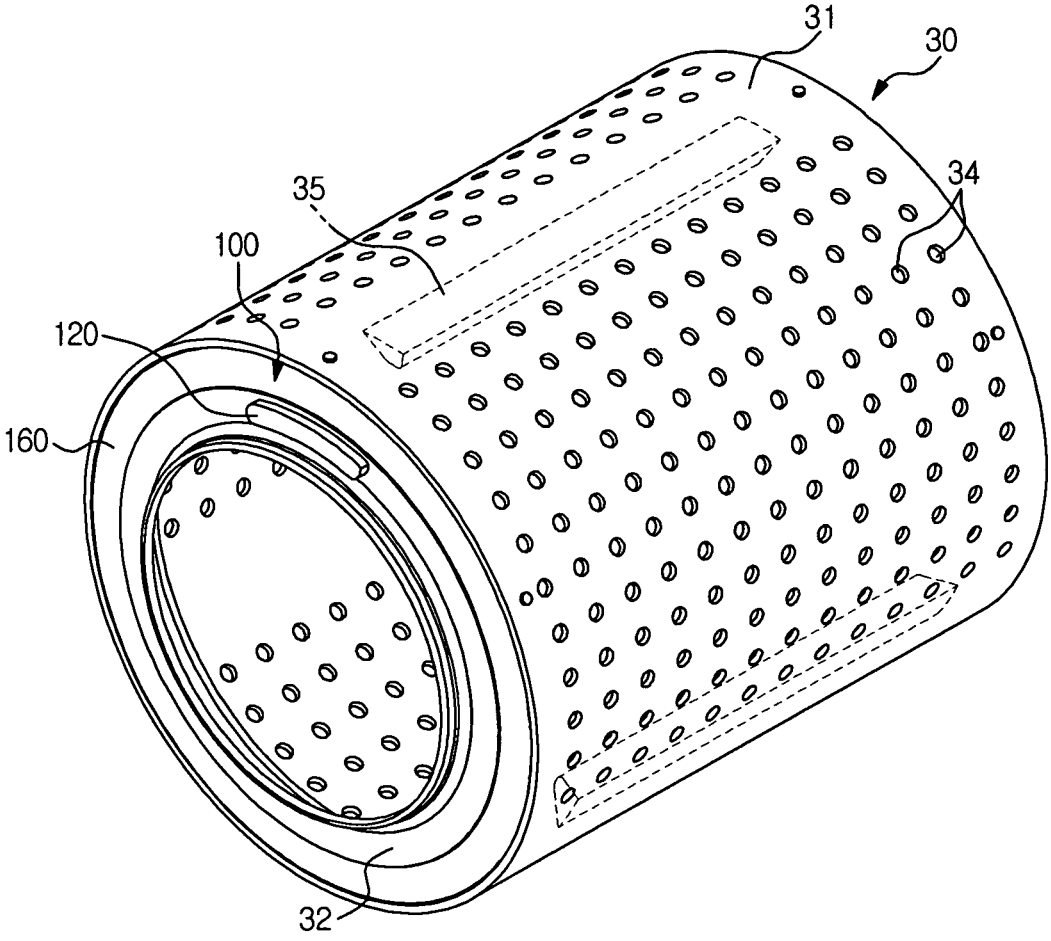
FIG. 2 is a perspective view illustrating an exemplary embodiment of a rotating tub and a balancer for a washing machine.
Figure 3:
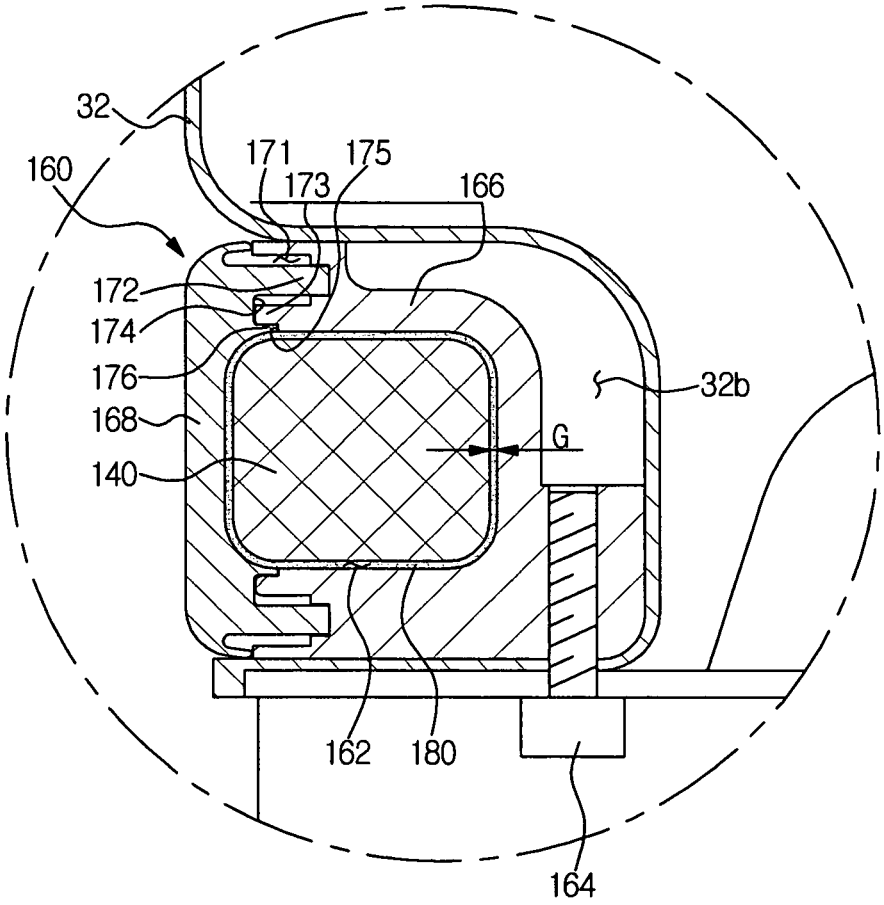
FIG. 3 is an enlarged partial view of FIG. 1.
Figure 4:
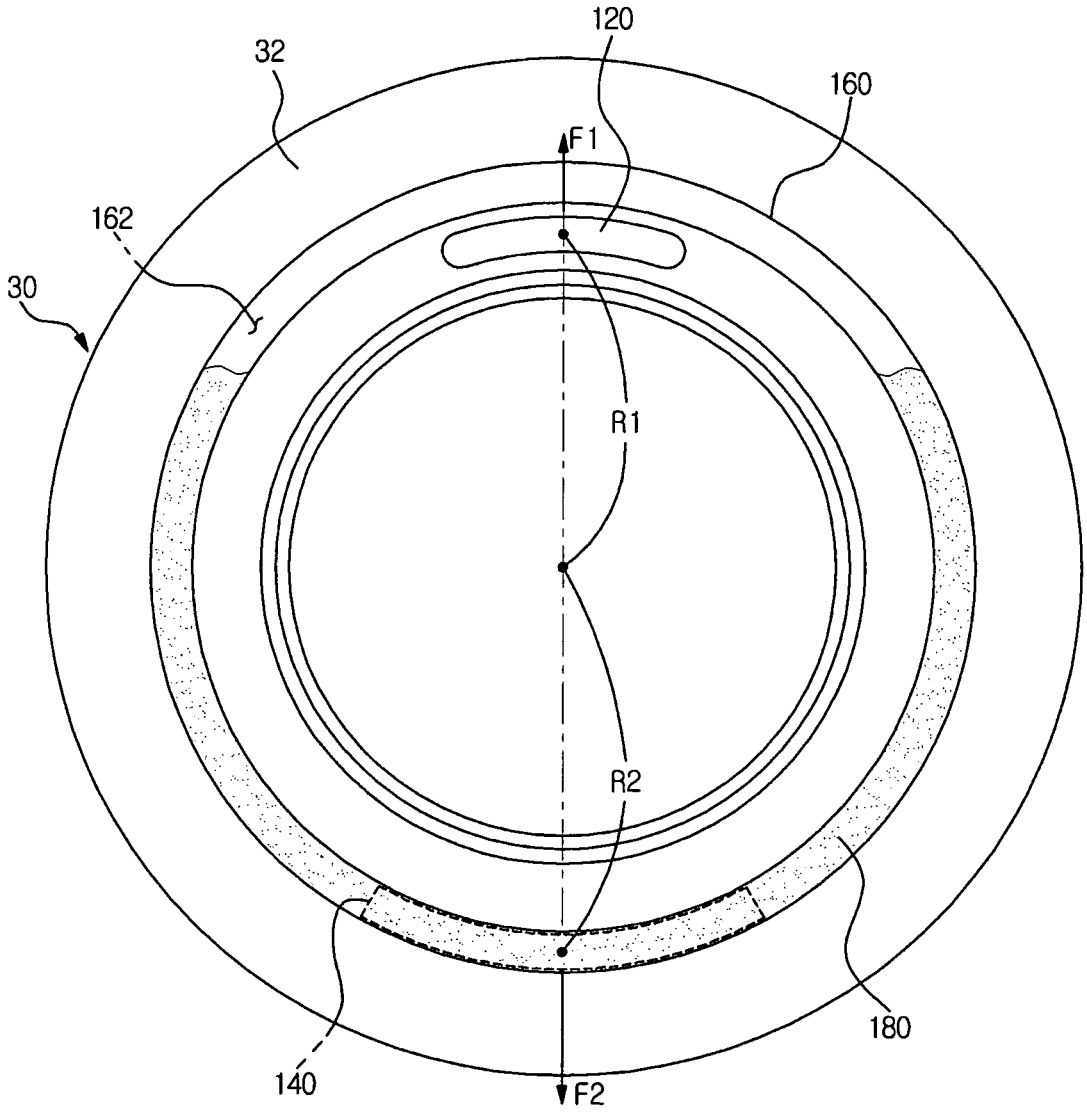
FIG. 4 is a front view illustrating an exemplary embodiment of a rotating tub and a balancer for a washing machine.

FIG. 2 is a perspective view illustrating an exemplary embodiment of the rotating tub and the balancer for the washing machine, FIG. 3 is an enlarged partial view of FIG. 1, and FIG. 4 is a front view illustrating an exemplary embodiment of the rotating tub and the balancer for the washing machine.

As shown in FIGS. 1 to 4, the balancer 100 includes a first mass member 120 and a second mass member 140 provided at the rotating tub 30.

The first mass member 120 serves to apply load imbalance to the rotating tub 30 during rotation of the rotating tub 30. The first mass member 120 may be fixed to the rotating tub 30 so as not to be moved relative to the rotating tub 30 in a circumferential direction of the rotating tub 30.

The second mass member 140 is arranged to be movable in the circumferential direction of the rotating tub 30 and serves to compensate for load imbalance applied to the rotating tub 30 during rotation of the rotating tub 30.

When the rotating tub 30 is rotated, the second mass member 140 is automatically moved to a position sufficient to remove load imbalance applied to the rotating tub 30. For example, if laundry is gathered in a specific partial region of the rotating tub 30 thus applying load imbalance to the rotating tub 30, the second mass member 140 is automatically moved to a position sufficient to compensate for the sum of centrifugal force generated by the gathered laundry and centrifugal force generated by the first mass member 120.

The first mass member 120 is used to apply load imbalance to the rotating tub 30 at the initial rotation stage of the rotating tub 30. This is to consider the case where laundry is evenly distributed in the rotating tub 30 and thus, load imbalance due to laundry is minimal.

When load imbalance due to laundry is minimal, the second mass member 140 installed to balance the rotating tub 30 may have an opposite effect applying load imbalance to the rotating tub 30, rather than compensating for the load imbalance. However, in an exemplary embodiment, the second mass member 140 is moved in an opposite direction of the first mass member 120 when load imbalance due to laundry is minimal, such that load imbalance due to the second mass member 140 and load imbalance due to the first mass member 120 offset each other. Accordingly, it may be possible to prevent the second mass member 140, i.e. a balancing mass member from applying load imbalance to the rotating tub 30 and thus, from generating vibration and noise when load imbalance due to laundry is minimal.

The first mass member 120 and the second mass member 140 may be made of a high specific-gravity material, e.g., a metallic material. For example, the first mass member 120 and the second mass member 140 may be made of brass.

A relationship between masses and positions of the first mass member 120 and the second mass member 140 may be determined such that centrifugal force F1 applied to the rotating tub 30 by the first mass member 120 during rotation of the rotating tub 30 is smaller than centrifugal force F2 applied to the rotating tub 30 by the second mass member 140. The centrifugal force F2 is set to be greater than the centrifugal force F1, to allow the second mass member 140 to compensate for load imbalance due to the first mass member 120 and load imbalance due to laundry even when the load imbalance due to laundry acts in the same direction as the centrifugal force F1.

The mass of the second mass member 140 may be greater than the mass of the first mass member 120 so that the centrifugal force F2 applied by the second mass member 140 is greater than the centrifugal force F1 applied by the first mass member 120. Even if laundry is gathered in a specific partial region such that load imbalance due to the laundry acts in the same direction as load imbalance due to the first mass member 120 and thus, the relatively large total sum of load imbalance acts on the rotating tub 30, the second mass member 140 may effectively compensate for the load imbalance acting on the rotating tub 30 by being moved in an opposite direction of the first mass member 120.

For example, assuming that the mass of the second mass member 140 is 1, the mass of the first mass member 120 may be within a range of 0.7 to 0.8.

However, the mass of the first mass member 120, the mass of the second mass member 140, and a ratio of the mass of the first mass member 120 to the mass of the second mass member 140 may be appropriately changed according to a volume of the rotating tub 30.

In addition, the first mass member 120 and the second mass member 140 may be positioned such that a rotation radius R2 of the second mass member 140 is greater than a rotation radius R1 of the first mass member 120 upon rotation of the rotating tub 30.

However, on the contrary, the mass of the first mass member 120 may be equal to or greater than the mass of the second mass member 140. In addition, the rotation radius R1 of the first mass member 120 may be greater than the rotation radius R2 of the second mass member 140.

As shown in FIGS. 2 to 4, the balancer 100 includes a balancer housing 160 having an annular channel 162 to receive the second mass member 140. The first mass member 120 and the balancer housing 160 may be mounted to the front plate 32 of the rotating tub 30. The first mass member 120 may be arranged inside the balancer housing 160 in a radial direction of the rotating tub 30. The first mass member 120 may be arranged between the front plate 32 and the tub 20 so as not to come into contact with laundry received in the rotating tub 30.

An annular recess 32*b* having an open front side is defined in the front plate 32 of the rotating tub 30, and the balancer housing 160 is received in the recess 32*b*. The balancer housing 160 may be coupled to the rotating tub 30 via a fastening member 164 so as to be firmly fixed to the rotating tub 30.

The balancer housing 160 includes an annular frame 166 having an open side, and a cover 160 to cover the open side of the frame 166. The annular channel 162 is defined by an inner surface of the frame 166 and an inner surface of the cover 168.

The frame 166 has first coupling grooves 171 at opposite sides of the channel 162, and the cover 168 has first coupling protrusions 172 to be coupled into the first coupling grooves 171. The frame 166 also has second coupling protrusions 173 formed between the first coupling grooves 171 and the channel 162, and the cover 168 has second coupling grooves 174 formed below the first coupling protrusions 172, such that the second coupling protrusions 173 of the frame 166 are coupled into the second coupling grooves 174 of the cover 168. In addition, the frame 166 has third coupling grooves 175 formed below the second coupling protrusions 173 immediately above the channel 162, and the cover 168 has third coupling protrusions 176 to be coupled into the third coupling grooves 175. With this coupling configuration, the frame 166 and the cover 168 may be firmly coupled to each other, and this may prevent leakage of a fluid, such as oil, received in the channel 162.

The second mass member 140 is sliding movable in the channel 162 of the balancer housing 160, and a damping fluid 180 is received in the channel 162 to prevent sudden movement of the second mass member 140.

The damping fluid 180 applies resistance to the second mass member 140 against force acting on the second mass member 140, thereby preventing sudden movement of the second mass member 140 in the channel 162. The damping fluid 180 may be oil, and may be charged to 70~80% of the overall volume of the channel 162. The damping fluid 180 plays a role in balancing of the rotating tub 30 together with the second mass member 140 upon rotation of the rotating tub 30.

Although only one mass member may be provided in the channel 162 as shown in FIG. 4, a plurality of mass members may be provided. When the plurality of mass members is provided, three or less mass members may be desirable. Also, it may be desirable that the total mass of the mass members is greater than the mass of the first mass member 120 even if the mass of each mass member is smaller than the mass of the first mass member 120.

As shown in FIG. 3, the second mass member 140 has a cross sectional shape corresponding to that of the channel 162 of the balancer housing 160. A cross sectional area of the second mass member 140 is determined to fill a cross sectional area of the channel 162 with only a slight tolerance. In this case, if the tolerance, i.e. a gap G between the second mass member 140 and an inner surface of the channel 162 is excessively small, the second mass member 140 may have difficulty in smooth movement in the channel 162 and it may take the second mass member 140 an excessively long time to be moved to a balancing position. On the other hand, if the gap G is excessively great, the second mass member 140 has excessive freedom in movement, having difficulty in stable maintenance of the balancing position thereof. With due regard to these reasons, an appropriate range of the gap G may be about 1~2 mm.

With the above described configuration in which the cross sectional shape of the second mass member 140 corresponds to the cross sectional shape of the channel 162, it may be possible to prevent the second mass member 140 from being suddenly moved and consequently, from escaping from the balancing position thereof when force caused by acceleration or speed reduction of the rotating tub 30 is applied to the second mass member 140.

The cross sectional shape of the second mass member 140 may be determined to have a constant size in the circumferential direction of the rotating tub 30. The second mass member 140 may have a rectangular column shape having a curvature in the circumferential direction of the rotating tub 30. Of course, the shape of the second mass member 140 is not limited to the rectangular column shape and may have a circular or polygonal column shape.

Figure 5:
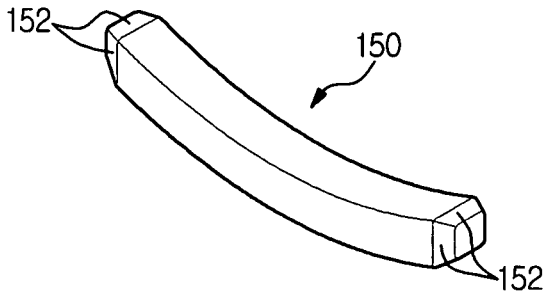
FIG. 5 is a perspective view illustrating an exemplary embodiment of a second mass member.

FIG. 5 is a perspective view illustrating an alternative embodiment of a second mass member. As shown in FIG. 5, the second mass member 150 may include tapered surface portions 152 at each end thereof. The tapered surface portions 152 may be formed respectively at edges of the end of the second mass member 150. When the second mass member 150 is moved in the damping fluid 180, the tapered surface portions 152 reduce resistance applied to the end of the second mass member 150 by the damping fluid 180, thereby improving mobility of the second mass member 150.

Similar to the second mass member 140 shown in FIGS. 3 and 4, when the second mass member 140 maintains the constant cross sectional shape and size corresponding to those of the channel 162 in a circumferential direction of the channel 162, this may effectively prevent sudden movement of the second mass member 140, but may extend a movement time of the second mass member 140 to the balancing position thereof.

For this reason, as shown in FIG. 5, when the tapered surface portions 152 are formed at the end of the second mass member 150 so as to reduce resistance applied to the second mass member 150 by the damping fluid, it may be possible to reduce a time required for the second mass member 150 to be moved to the balancing position thereof while preventing sudden movement of the second mass member 150.

Although the tapered surface portions 152 may be formed of flat surfaces as shown in FIG. 5, the tapered surface portions 152 may be formed of curved surfaces having a predetermined curvature.

Figure 6:
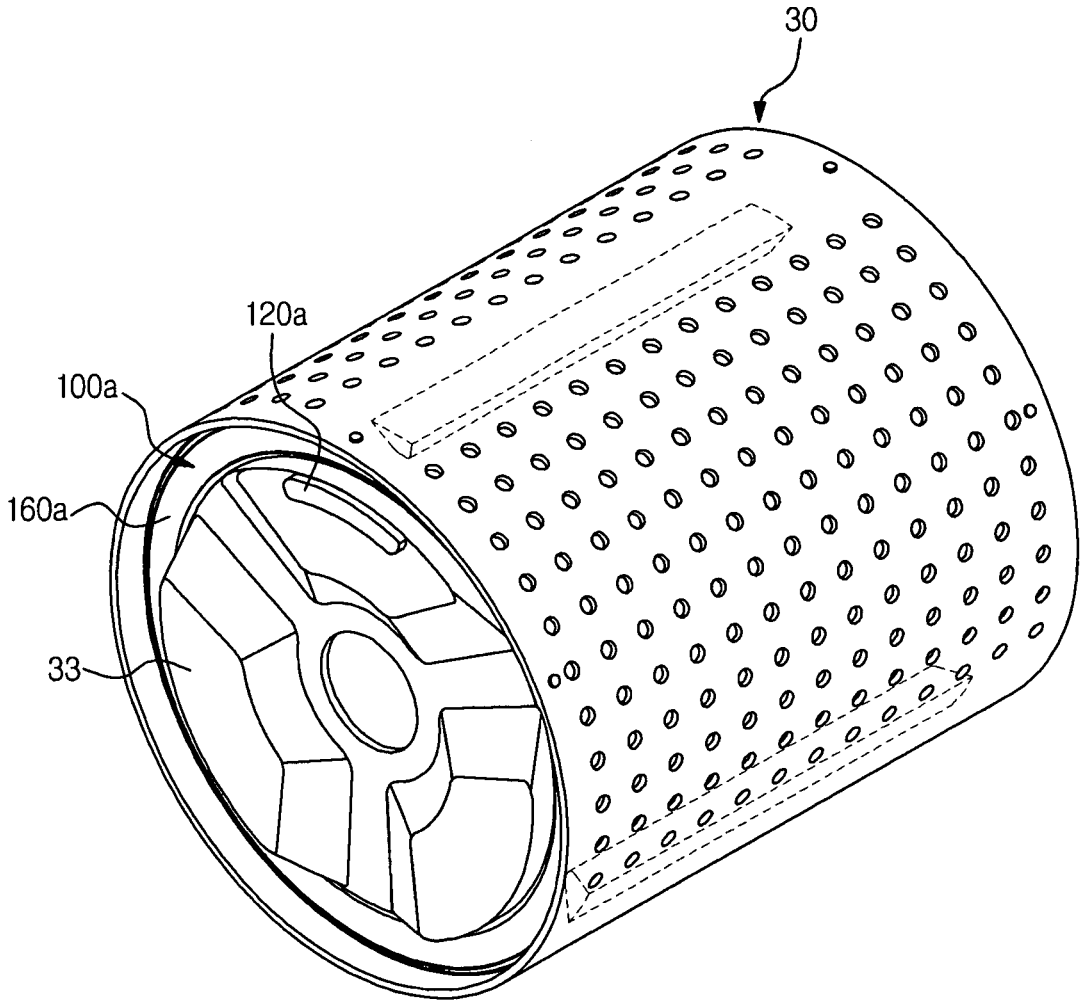
FIG. 6 is a perspective view illustrating an exemplary embodiment of a balancer that is installed to a rear plate of a rotating tub for a washing machine.

FIG. 6 is a perspective view illustrating an exemplary embodiment of a balancer that is installed to the rear plate of the rotating tub for the washing machine.

As shown in FIG. 6, a balancer 100*a* may be installed even to the rear plate 33 of the rotating tub 30. The balancer 100*a* installed to the rear plate 33 has a configuration similar to that of the balancer 100 installed to the front plate 32 and thus, a repetitious description thereof will be omitted.

To improve performances of both the balancers 100 and 100*a*, it may be desirable that the balancer housing 160 installed to the front plate 32 and a balancer housing 160*a* installed to the rear plate 33 are arranged at the same radial position of the rotating tub 30. In addition, it may be desirable that the first mass member 120 installed to the front plate 32 and a first mass member 120*a* installed to the rear plate 33 are arranged at the same radial and circumferential position of the rotating tub 30.

Figure 7:
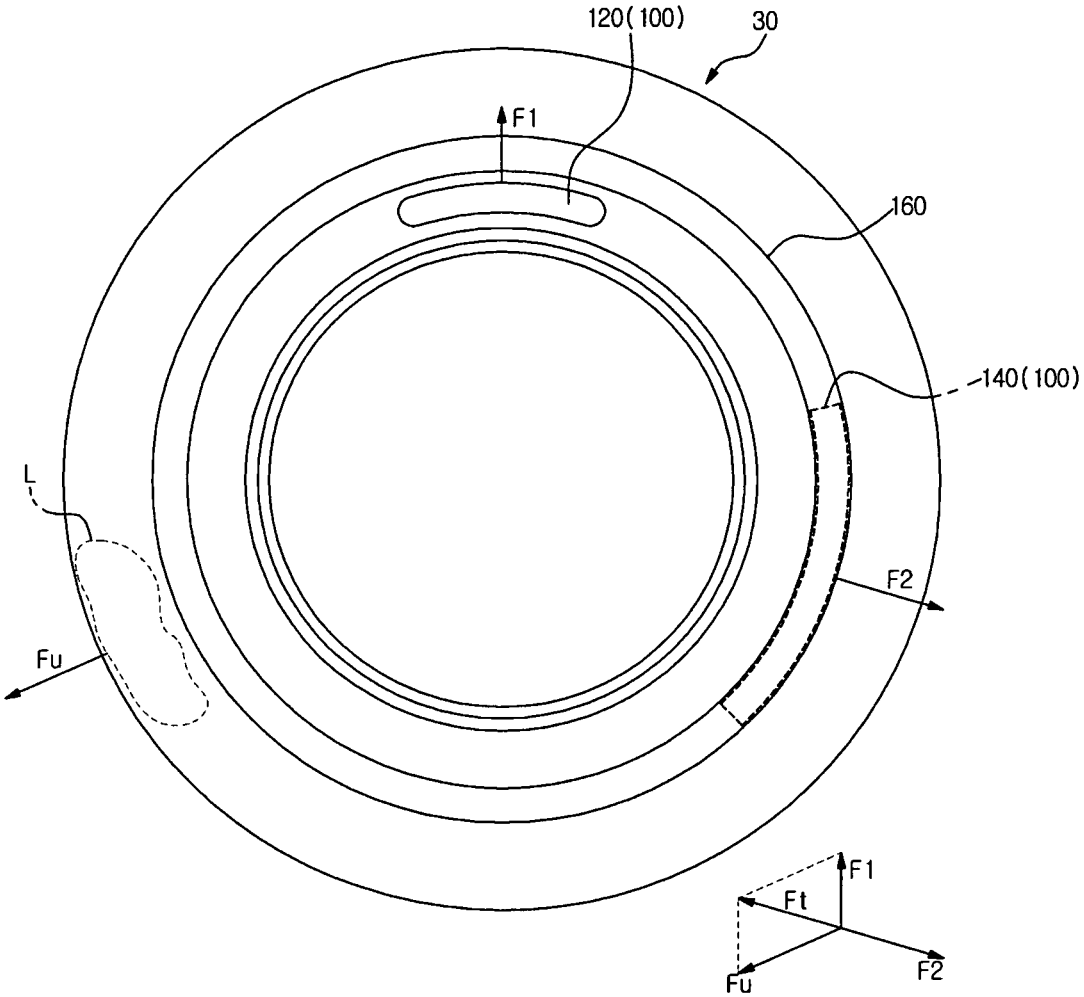
FIGS. 7 to 9 are views illustrating operation of a balancer for a washing machine according to an exemplary embodiment.
Figure 8:
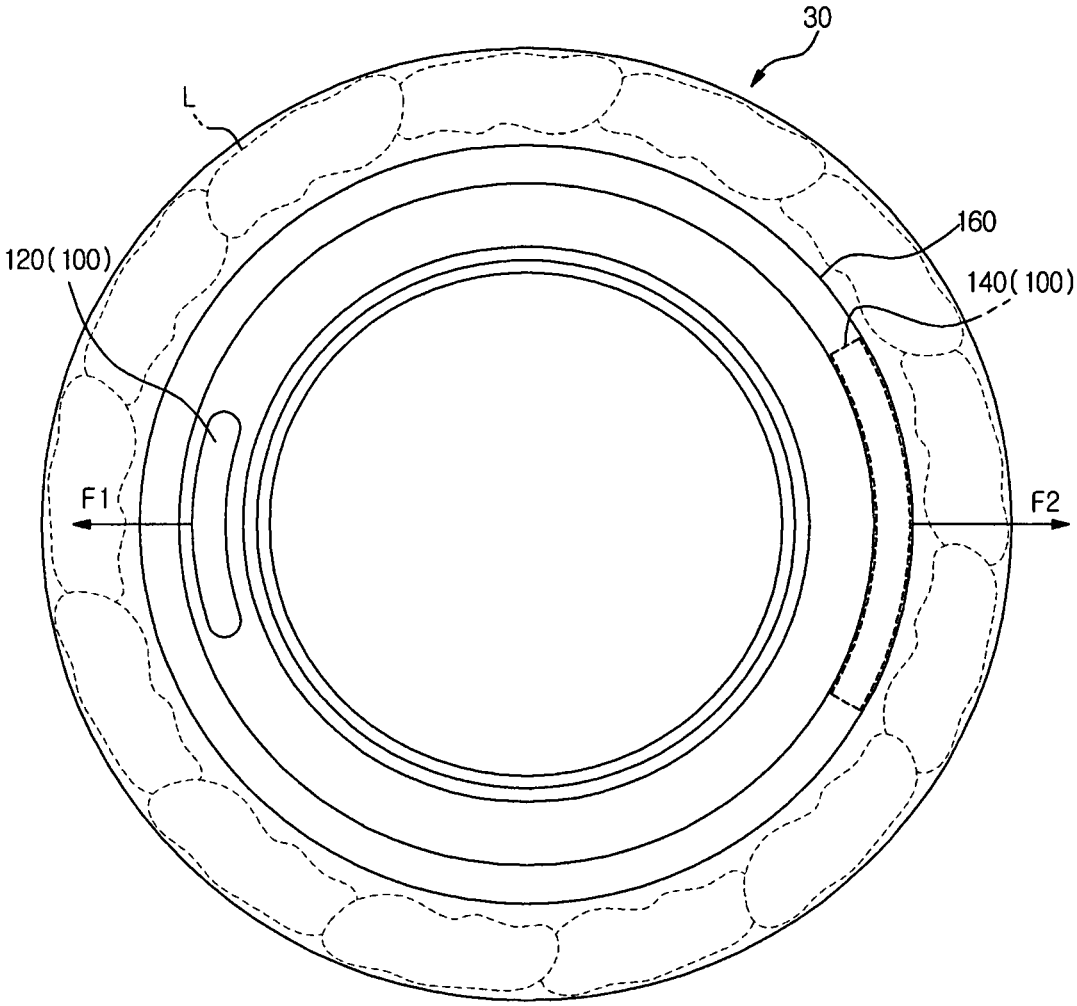
Figure 9:
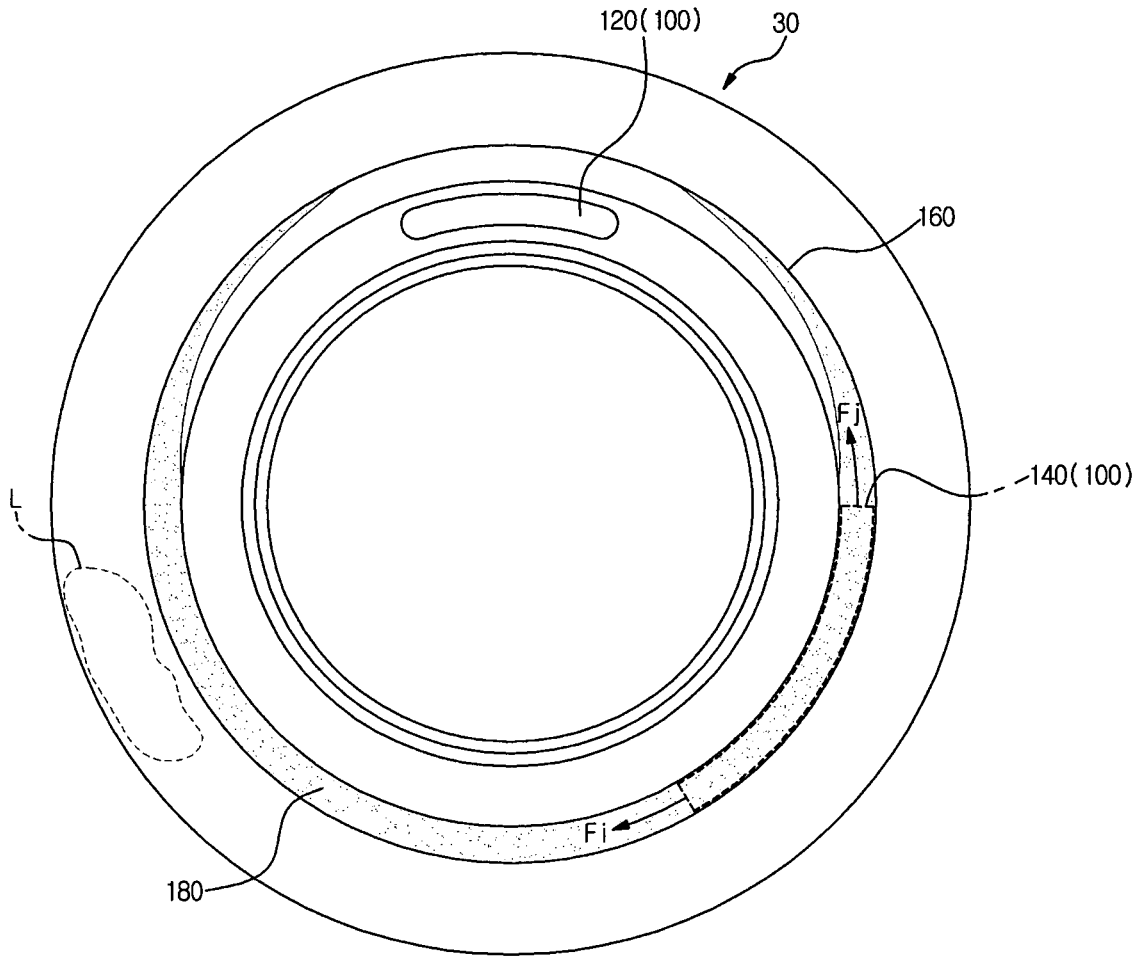

FIGS. 7 and 9 are views illustrating operation of the balancer for the washing machine according to an exemplary embodiment of the present invention. In FIGS. 7 and 8, the damping fluid is not illustrated.

Upon dehydration (drying) of laundry L, the rotating tub 30 is rotated at a high speed by the motor 40. If the laundry L is gathered in a specific partial region during rotation of the rotating tub 30 as shown in FIG. 7, the rotating tub 30 is affected by load imbalance Fu due to the gathered laundry L. In addition, the rotating tub 30 is affected by load imbalance F1 due to the first mass member 120 that is arranged at one side of the rotating tub 30. Accordingly, load imbalance Ft as the total sum of the load imbalance Fu and the load imbalance F1 acts on the rotating tub 30.

Under the influence of the load imbalance Ft, the second mass member 140 of the balancer 100 slides to a position sufficient to compensate for the load imbalance Ft, i.e. slides in a direction opposite to an acting direction of the load imbalance Ft, thereby stabilizing rotational motion of the rotating tub 30. FIG. 7 illustrates the second mass member 140 located at the balancing position.

As shown in FIG. 8, if the laundry L is evenly distributed in the rotating tub 30 and thus, only a slight or substantially no load imbalance due to the laundry L is present, the second mass member 140 slides to a position sufficient to compensate for the load imbalance F1 due to the first mass member 120, i.e. slides in an opposite direction of the first mass member 120, thereby stabilizing rotational motion of the rotating tub 30.

Accordingly, it may be possible to prevent a balancing mass member from applying load imbalance and thus, from generating vibration and noise when load imbalance due to laundry is minimal.

In the meantime, as shown in FIG. 9, even if the second mass member 140 is affected by inertial force Fi and Fj as the rotating tub 30 is accelerated or reduced in speed in a state wherein the second mass member 140 is located at the balancing position thereof, the damping fluid may prevent sudden movement of the second mass member 140 and consequently, the second mass member 140 may be kept at the balancing position thereof.

As apparent from the above description, the balancer having the above described configuration may effectively compensate for load imbalance acting on the rotating tub, thereby stabilizing rotational motion of the rotating tub.

Further, it may be possible to prevent the balancing mass member from unintentionally generating vibration and noise when load imbalance due to laundry is minimal.

Although a few embodiments have been shown and described, it would be appreciated by those skilled in the art that changes may be made in these embodiments without departing from the principles and spirit of the invention, the scope of which is defined in the claims and their equivalents.

What is claimed is:

1. A washing machine, comprising:

a tub; and a rotating tub rotatably arranged in the tub, the rotating tub comprising a cylindrical portion;

a front plate arranged at a front end of the cylindrical portion, the front plate having an opening for the entrance or exit of laundry;

a rear plate arranged at a rear end of the cylindrical portion;

a first mass member fixedly and directly mounted to at least one of an annular portion of the front plate and a rear surface of the rear plate so as not to be moved relative to the rotating tub in a circumferential direction of the rotating tub, the first mass member being fixedly mounted in only an arcuate portion of the at least one of the front plate and the rear plate whereby the first mass member applies load imbalance to the rotating tub upon rotation of the rotating tub;

a balancer housing having an annular channel directly mounted to at least one of the front plate and the rear plate; and only a single second mass member received in the annular channel and arranged to be movable in the circumferential direction of the rotating tub, the second mass member serving to compensate for load imbalance of the rotating tub upon rotation of the rotating tub.

2. The washing machine according to claim 1, wherein a cross section of at least a part of the second mass member has a shape corresponding to the cross section of the annular channel in a circumferential direction.

3. The washing machine according to claim 1, wherein a fluid is received in the annular channel to prevent sudden movement of the second mass member.

4. The washing machine according to claim 1, wherein the first mass member is arranged inside the balancer housing in a radial direction of the rotating tub.

5. The washing machine according to claim 1, wherein a mass of the second mass member is greater than a mass of the first mass member.

6. The washing machine according to claim 1, wherein a distance between the shaft and the second mass member is greater than a distance between the shaft and the first mass member.

7. The washing machine according to claim 1, wherein the circumferential movement of the second mass member is performed only by sliding movement.

8. The washing machine according to claim 1, wherein a cross section of the second mass member has a constant size in the circumferential direction of the rotating tub.

9. The washing machine according to claim 1, wherein the second mass member has a tapered surface portion formed at an end thereof.

10. A rotating tub configured to be rotatable about a shaft of a washing machine, the rotating tub comprising:

a cylindrical portion;

a front plate arranged at a front end of the cylindrical portion, the front plate having an opening for the entrance or exit of laundry;

a rear plate arranged at a rear end of the cylindrical portion;

a first mass member fixedly and directly installed on one surface of at least one of an annular portion of the front plate and a rear surface of the rear plate and being fixedly mounted in only an arcuate portion of the at least one of the front plate and the rear plate whereby the first mass member applies load imbalance to the rotating tub upon rotation of the rotating tub;

a balancer housing directly mounted to at least one of the front plate and the rear plate and having an annular channel therein;

only a single second mass member arranged to slide in the channel; and a damping fluid received in the channel and serving to apply resistance to the second mass member so as to prevent sudden movement of the second mass member.

11. The rotating tub according to claim 10, wherein a mass of the second mass member is greater than a mass of the first mass member.

12. The rotating tub according to claim 10, wherein a cross section of the second mass member has a shape corresponding to a cross section of the channel in the circumferential direction and the cross section of the second mass member has a constant size in the circumferential direction of the rotating tub.

* * * * *